US006420823B1

(12) United States Patent
Tanaka

(10) Patent No.: US 6,420,823 B1
(45) Date of Patent: Jul. 16, 2002

(54) SHADOW MASK STRUCTURE AND COLOR CRT

(75) Inventor: Yoshito Tanaka, Shiga (JP)

(73) Assignee: NEC Corporation, Tokyo (JP)

( * ) Notice: Subject to any disclaimer, the term of this patent is extended or adjusted under 35 U.S.C. 154(b) by 160 days.

(21) Appl. No.: 09/630,807

(22) Filed: Aug. 2, 2000

(30) Foreign Application Priority Data

Oct. 28, 1999 (JP) ..... 11-307227

(51) Int. Cl.[7] ..... H01J 29/80
(52) U.S. Cl. ..... 313/402; 313/407
(58) Field of Search ..... 313/402, 407

(56) References Cited

FOREIGN PATENT DOCUMENTS

| | | |
|---|---|---|
| JP | 10-106449 | 4/1998 |
| JP | 11-273586 | 10/1999 |

*Primary Examiner*—Vip Patel
(74) *Attorney, Agent, or Firm*—Scully, Scott, Murphy & Presser

(57) ABSTRACT

In a shadow mask structure, by making the radii of curvature at the center and peripheral parts of a shadow mask different, even if the temperature of the shadow mask structure rises during use in a color CRT, there is extremely small deformation of the shadow mask and small landing error, so that there is no problem with loss of color purity attributed caused thereby.

10 Claims, 12 Drawing Sheets

X-X' CROSS-SECTIONAL VIEW

X-X' CROSS-SECTIONAL VIEW

X-X' CROSS-SECTIONAL VIEW

X-X' CROSS-SECTIONAL VIEW

SHADOW MASK STRUCTURE AND COLOR CRT

BACKGROUND OF THE INVENTION

1. Field of the Invention

The present invention relates to a shadow mask and a color CRT, and more particularly to a shadow mask having a structure in which a shadow mask is provided in only one direction, and to a color CRT that uses a shadow mask of this construction.

2. Background of the Invention

We will show two references as follows.

The cited reference 1 denotes a color selecting mechanism of cathode-ray tube and frame for its color selecting mechanism which is disclosed in Japanese Unexamined Patent Application Publication No. 10106449A. This application intends to obtain a curved surface where a frame surface is single or close to this by constituting so that a surface to which a color selecting electrode thin plate is fixed is formed as a curved surface having at least one or more inflection points while proceeding to an end part from a central part.

After support members of a frame are molded by press working or the like so that the whole become respectively necessary curvature in the Y direction and the Z direction, a curved surface of a surface to which the support members are welded is formed by cutting work. The surface is a curved surface on/to which a color selecting electrode thin plate is stretched/welded, and is defined by a fifth-degree equation expressed by, for example, an equation. In this way, since the surface to which the color selecting electrode thin plate of the frame is fixed is formed as a curved surface having at least one or more inflection points while proceeding to an end part of a central part, a curved surface where a frame surface is single or close to this, can be obtained.

The cited reference 2 denotes a cathode-ray tube which is disclosed In Japanese Unexamined Patent Application Publication No.11273586A. This application intends to prevent deterioration of images due to vibration of an AG tape.

In this cathode-ray tube comprising an aperture grill having a large number of slit holes, a frame supporting the aperture grill, and a color selecting mechanism having vibration control wires tightly stretched on the aperture grill, the aperture grill are supported by the frame so as to form approximately cylindrical face with three curvature radiuses, so that the pressurizing force of the vibration control wires can largely be applied especially to the points where the AG tape is easily vibrated.

In recent years, there has been an increase in so-called flat color CRTs, in which the glass panel surface is substantially flat. FIG. 7 shows a partial perspective cross-sectional view of a glass panel 700 for use in a flat CRT. In this drawing, the reference numeral 701 is a glass panel surface (outside of the color CRT), and 702 is the glass panel inner surface (inside of the color CRT). As shown in this drawing, even if the glass panel surface 701 is substantially flat, the thickness of the glass panel cross-section is thicker toward the periphery than at the center, and has the shape of a concave lens that forms a part of a cylinder. The first reason for this is that, if the glass thickness at the periphery were to be the same as at the center, the withstanding pressure of the glass bulb would become low, and because there is a great danger of implosion in a color CRT. The second reason is that, if the glass thickness at the periphery is the same as that at the center, the image will appear to have an unnatural dimpling effect. To prevent implosion and impart an appearance of flatness to the image, the glass thickness is made greater toward the periphery, with respect to a reference thickness at the center of the glass panel cross-section. The amount of increase in glass thickness at the periphery with respect to the center is the wedge amount W, as shown in the drawing. The wedge amount W has an appropriate value, which is dependent upon the size of the color CRT. For example, for a 19-inch color CRT, the proper wedge amount is 3 mm.

Because as noted above the glass panel inner surface 702 has the shape of a concave lens that forms a part of a cylinder, a shadow mask of the past was accordingly made as a cylinder type with a constant radius of curvature that is substantially congruent with the glass panel inner surface 702.

FIG. 8 is a perspective view of a shadow mask structure 800 of the past. In this drawing, the reference numeral 801 is a mask frame, 802 is a shadow mask (only the periphery of which is shown, to make the inside of the mask frame 801 more visible), and 802A is a shadow mask welding point. The shadow mask 802 is tensioned via the shadow mask welding point 802A at two sides of the mask frame 801.

FIG. 9 is a cross-sectional view of the shadow mask 800 of the past, in the direction of X–X'. As shown in this drawing, the shadow mask 800 of the past has a constant radius of curvature R0 everywhere, and is cylindrical in shape. This radius of curvature R0 is, for example, approximately 4050 mm for a 19-inch color CRT.

The above-described shadow mask 800 of the past, however, has the following problems. When manufacturing a color CRT, the shadow mask 802 is tensioned onto the mask frame 801 at room temperature (approximately 25° C.). For this reason, the shadow mask 802 maintains a normal tensioned condition, with no deformation, at room temperature. That is, the shadow mask 802 maintains a non-deformed and normal tensioned condition when the color CRT is not being used.

However, when the color CRT is in use, because an electron beam collides with the shadow mask 802, the shadow mask structure 800 rises to a temperature of approximately 60° C. Because the shadow mask 802 is made of Invar (36% nickel iron alloy), which has a low coefficient of thermal expansion, there is almost no thermal expansion, the coefficient of thermal expansion of Invar being approximately 1.2 ppm/K at room temperature. Because the mask frame 801, however, is made of 13 chromium stainless steel, which has a coefficient of thermal expansion approximately 10 times that of Invar, it exhibits considerable thermal expansion. Because of the difference in thermal expansion between the shadow mask 802 and the mask frame 801, the shadow mask 802 is subjected to stress.

FIG. 10 is a plan view of the shadow mask 802 of a shadow mask structure 800 of the past, seen from the direction A. In this drawing, F indicates the distribution of stress on a side of he shadow mask 802 attributed to the difference in coefficients of thermal expansion between the shadow mask 802 and the mask frame 801. Because the shadow mask 802 is free in the lateral direction, stress is not applied to the left and right sides thereof. In contrast to this, because the top and bottom sides of the shadow mask 802 are welded to the mask frame 801, because of the thermal expansion of the short side of the mask frame 801, a stress F is applied to the as shown in the drawing, this being small at the center of the side and large at the periphery of the side. Because of the non-uniform distribution of this stress F, a stress is developed in the shadow mask 802 perpendicular to the stress F, thereby pulling the shadow mask 802 downward, resulting in the deformation of the shadow mask described below.

FIG. 11 shows a plan view of the shadow mask 802 of the shadow mask structure 800 of the past from the direction A of FIG. 8, and the X–X' and Y–Y' cross-sectional views thereof. In these cross-sectional views, the condition shown is that in which the shadow mask 802 is at 25° C. (broken line) and at 60° C. (solid line). As shown in this drawing, when the temperature of the shadow mask structure rises, the shadow mask 802 is deformed by pulling in a direction that moves it away from the glass panel 700 of the color CRT. The amount of deformation is greatest near the center of the shadow mask 802 and, by experiments performed by the inventors, this was found to be approximately 100 $\mu$m near the center, as shown in the drawing. As is known, when the distance between the shadow mask and the color panel 700 changes, landing error occurs in the electron beam. When this occurs, the change in distance between the shadow mask 802 and the glass panel 700 is greatest near the center of the shadow mask 802, and because the electron beam is incident substantially perpendicularly to the glass panel 700 at in the center region, landing error tends not to occur. At the periphery of the shadow mask 802, because the change in distance between the shadow mask 802 and the glass panel 700 is small, the landing error is small. As a result, in the region 802B indicated by hatching in FIG. 12 (plan view of the shadow mask 802), that is, in a range of ⅙ to ⅔ from both edges of the shadow mask 802, the landing error is the greatest. An experiment by the inventors indicated that, for a deformation of approximately 100 $\mu$m at the center region of the shadow mask 802, the landing error in the region 802B is approximately 20 $\mu$m. With an electron beam landing error of 20 $\mu$m, there is a clearly perceivable decrease in color purity.

That is, a shadow mask structure of the past, which had a cylindrical shadow mask with a constant radius of curvature, there was the problem of a decrease of color purity when the color CRT was used.

Accordingly, it is an object of the present invention to provide a shadow mask structure that, by properly establishing the radius of curvature of the shadow mask, has a small amount of shadow mask deformation and a small amount of landing error, even if the temperature of the shadow mask rises when the color CRT is used.

It is a further object of the present invention to provide a color CRT using the above-noted shadow mask, which features superior color purity, a natural flat appearance, and sufficient withstanding pressure.

SUMMARY OF THE INVENTION

In order to achieve the above-noted objects, a shadow mask structure according to the present invention features radii of curvature at the center part of the screen and at the peripheral part of the screen that are appropriately established as different values.

Specifically, a first aspect of the present invention is a shadow mask structure formed by a mask frame having a substantially rectangular outer frame and a shadow mask that is substantially rectangular and that is tensioned on a pair of sides of the mask frame, wherein the part of the mask frame onto which the shadow mask is tensioned is formed by a combination of a plurality of arcs, the radii of curvature of the plurality of arcs becoming successively smaller with movement from the mask frame center to the mask frame periphery, the cross-section of the shadow mask that is parallel to the shadow mask tensioned part having substantially the same shape as the shadow mask tensioned part of the mask frame.

In a second aspect of the present invention the shadow mask tensioned part of the mask frame is a combination of arcs that has two radii of curvature, wherein approximately ⅔ at the center part of the mask frame has the larger of the two radii of curvature, and the left and right ⅙ have the smaller of the two radii of curvature.

In a third aspect of the present invention, the larger radius of curvature of the arc is approximately 4500 mm to 6000 mm, and the smaller radius of curvature of the arc is approximately 1000 mm to 2000 mm.

In a fourth aspect of the present invention, the material of the shadow mask tensioned part of the mask frame is Invar, with the material of the other parts of the mask frame being 13 chromium stainless, the shadow mask material being Invar.

A fifth aspect of the present invention is a shadow mask having a mask frame having a substantially rectangular outer frame and a shadow mask that is substantially rectangular, this shadow mask structure having a pair of mask supporting elements on a pair of longer sides of the mask frame, a pair of long sides of the shadow mask being tensioned to the mask supporting elements, and the shadow mask tensioned part of the mask supporting elements being formed by a plurality of arcs, the radii of curvature of the plurality of arcs becoming successively smaller with movement from the center of the mask supporting elements toward the periphery thereof, a cross-section of the shadow mask that is parallel to the mask supporting elements having a shape that is substantially the same as the shadow mask tensioned part of the mask supporting elements.

In a sixth aspect of the present invention, the shadow mask tensioned part of the mask supporting elements is a combination of arcs that has two radii of curvature, where substantially ⅔ of the center part of the mask supporting elements is an arc having the larger of the radii of curvature and the substantially ⅙ of the shadow mask supporting elements to the right and left sides have the smaller of the two radii of curvature.

In a seventh aspect of the present invention, the larger radius of curvature of the arc is approximately 4500 mm to 6000 mm, and the smaller radius of curvature of the arc is approximately 1000 mm to 2000 mm. In an eighth aspect of the present invention, the material of the mask frame is 13 chromium stainless steel, and the material of the mask supporting elements and the shadow mask is Invar.

In a ninth aspect of the present invention, the shape of the hole in the shadow mask through which the electron beam passes is substantially rectangular.

A tenth aspect of the present invention is a color CRT making use of a shadow mask structure according to any one of the first through the ninth aspects of the present invention.

BRIEF DESCRIPTIONS OF THE DRAWINGS

DETAILED DESCRIPTION OF THE PREFERRED EMBODIMENTS

Embodiments of a shadow mask structure according to the present invention are described in detail below, with references being made to relevant accompanying drawings.

Figure 1:
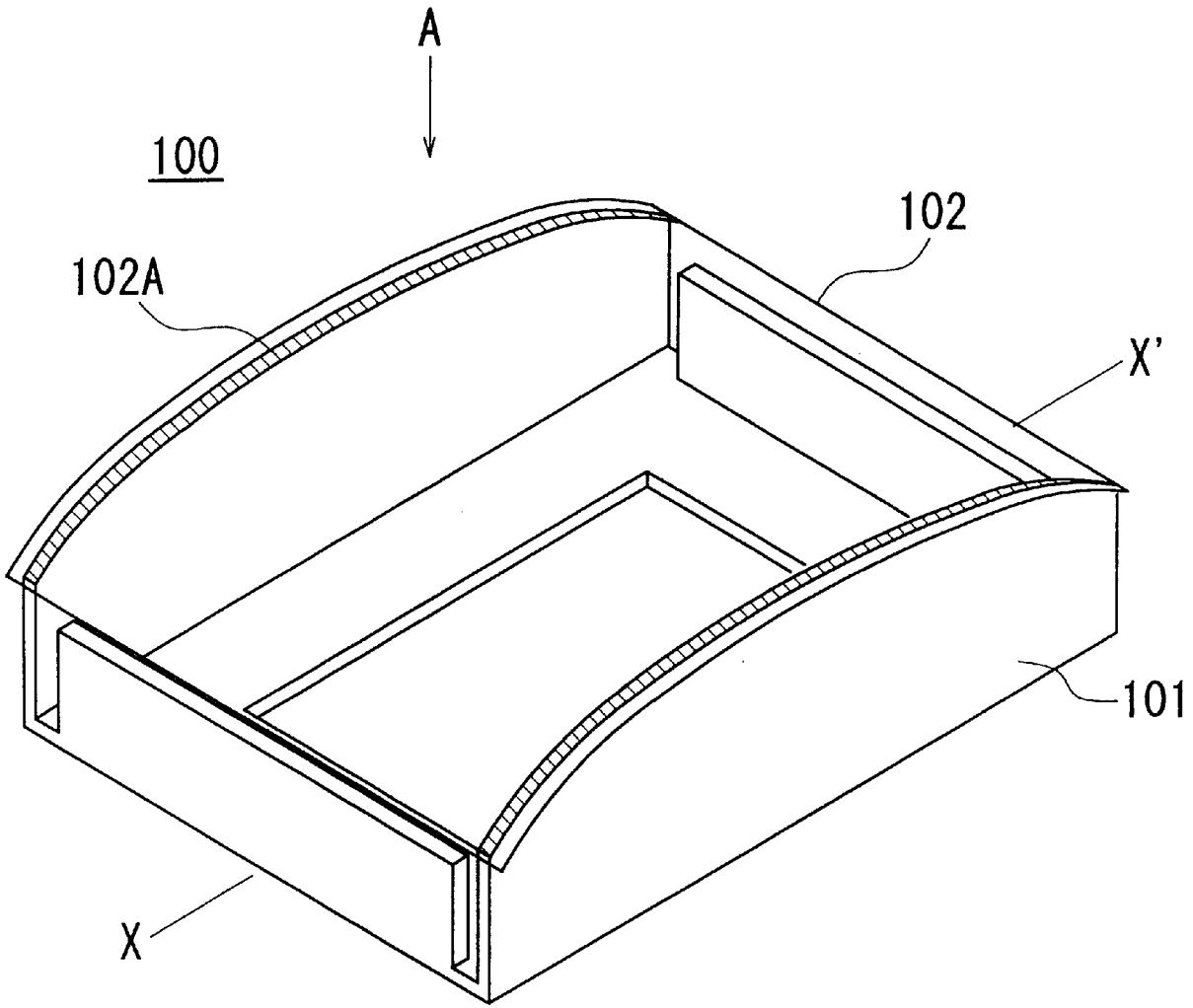
FIG. 1 is a perspective view of a first embodiment of a shadow mask structure according to the present invention.

FIG. 1 is a perspective view showing a shadow mask structure 100 according to a first embodiment of the present invention. In this drawing, the reference numeral 101 denotes a mask frame, 102 is a shadow mask (only the periphery of which is shown, to make the inside of the mask frame 101 more visible), and 102A is the shadow mask welding point. The electron beam passage holes (not shown in the drawing) of the shadow mask 102 are rectangular, with a vertical dimension of approximately 260 $\mu$m, and a horizontal dimension of approximately 60 $\mu$m, the vertical direction thereof being parallel to the short sides of the shadow mask 102.

The shadow mask 102 is tensioned from two sides (long sides) of the mask frame 101, via the shadow mask welding points 102A.

The long sides of the mask frame 101 are 2.2 mm-thick Invar, and other parts are 2.2 mm-thick 13-chromium stainless steel, the shadow mask 102 being 0.1 mm-thick Invar. The approximate dimensions of the shadow mask structure 100 are 360 mm on the long sides, and 270 mm on the short sides, with a height of 43 mm, for a 19-inch color CRT.

Figure 2:
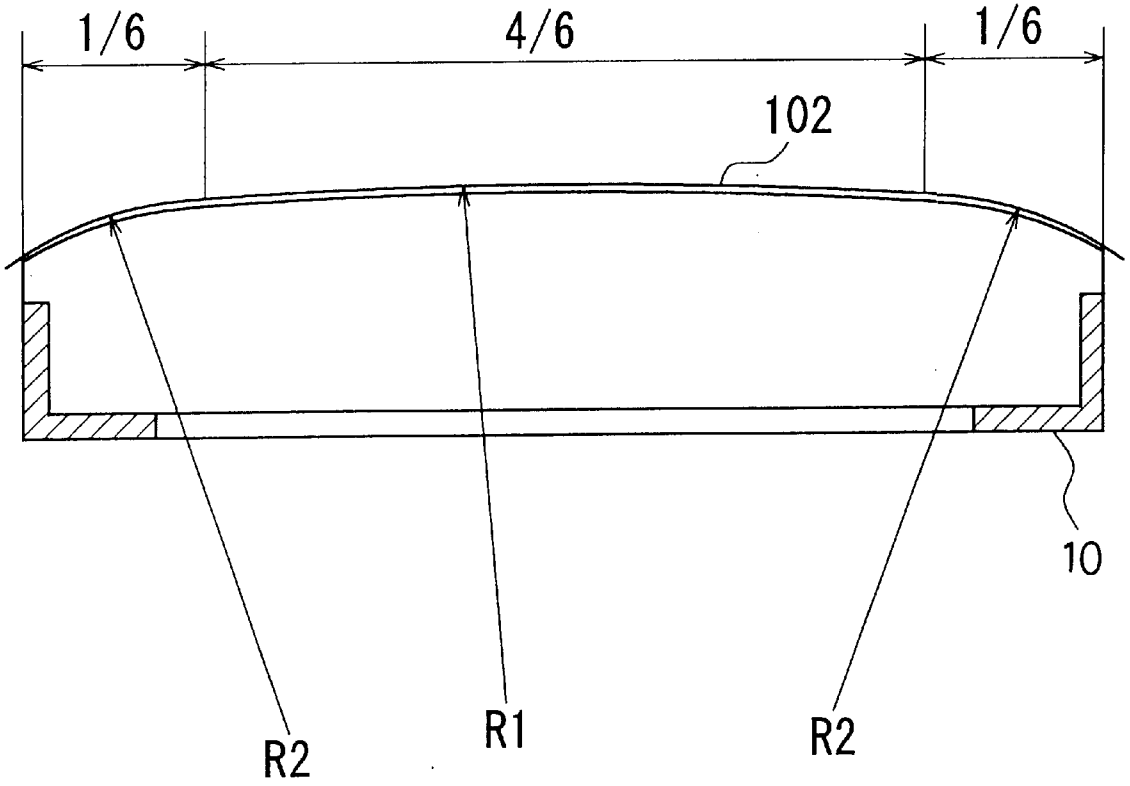
FIG. 2 is a cross-sectional view of the first embodiment of a shadow mask structure according to the present invention.

FIG. 2 is an X–X' cross-sectional view of a shadow mask structure according to the first embodiment of the present invention. As shown in FIG. 2, the cross-sectional shape of the shadow mask 102 (which is the same as the shape of the upper surface of the mask frame 101), is such that the center ⅔ is an arc with a radius of R1, and the left and right ⅓ thereof are arcs with a radius of R2. The radii of curvature R1 and R2 are such that the condition R2<R0<R1 is satisfied, where R0 is the radius of curvature of a shadow mask structure 800 of the past. Specifically, with respect an RD of 3050 mm, R1 is 5090 mm, and R2 is 1530 mm. With the above-noted shapes the mask frame 101 and shadow mask 102 present no particular problems in manufacturing a shadow mask structure 100 according to the first embodiment of the present invention.

In a shadow mask structure 100 according to the first embodiment, by a mechanism similar to the case of a shadow mask structure 800 of the past, there is deformation of the shadow mask 102. However, with the shadow mask structure 100 of the present invention, the degree of deformation of the shadow mask 102 is small, as is described below, with reference to FIG. 3.

Figure 3:
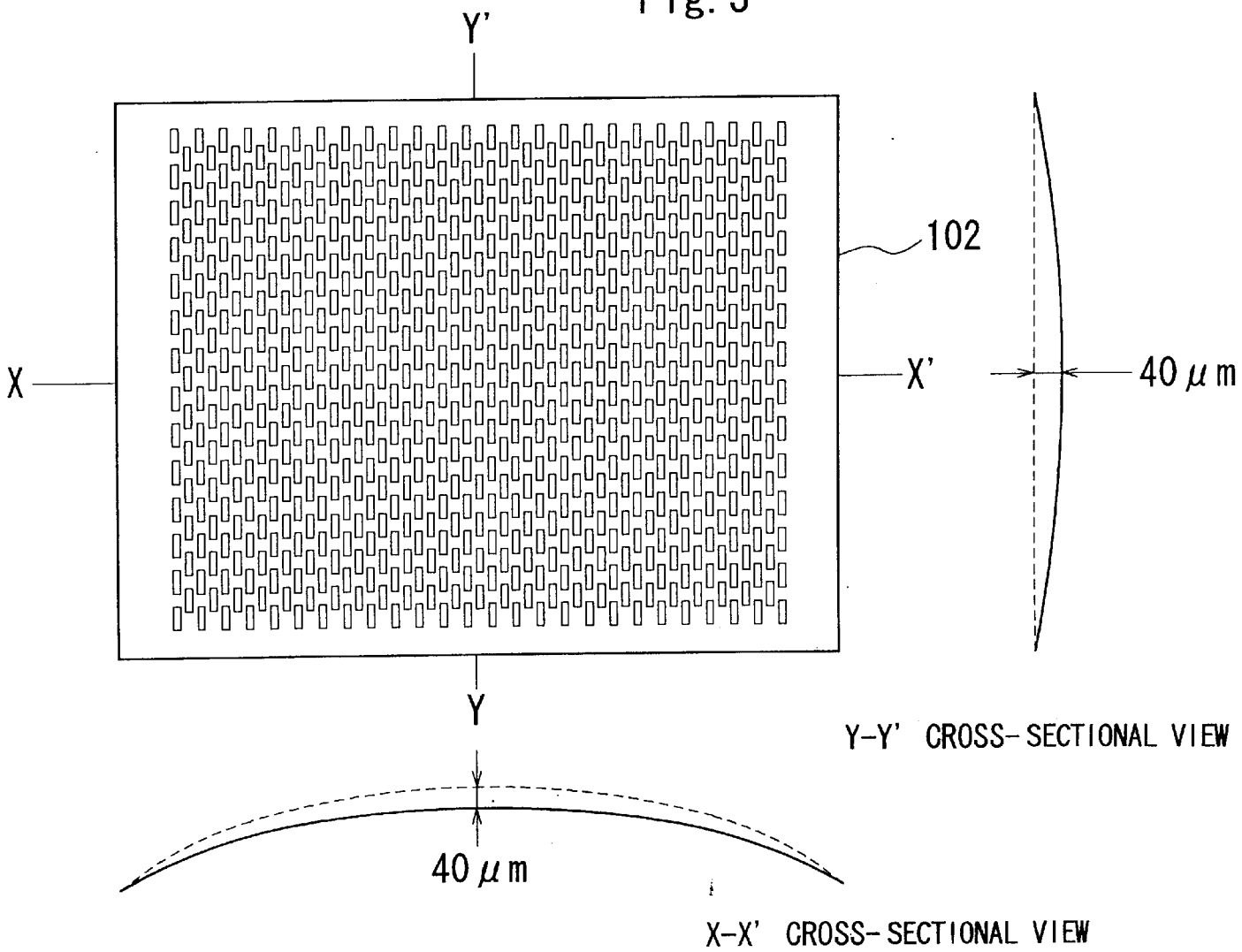
FIG. 3 is a plan view and two cross-sectional views of a shadow mask of a shadow mask structure according to the first embodiment of the present invention.

FIG. 3 is a plane view of a shadow mask 102 of a shadow mask structure 100 according to the present invention, viewed from direction A indicated in FIG. 1, and the X–X' and Y–Y' cross-sectional views thereof. In the cross-sectional views, the broken line shows the cross-sectional shape of the shadow mask 102 at 25° C., and the solid line shows the cross-sectional shape of the shadow mask 102 at 60° C. As shown in this drawing, when the temperature of the shadow mask structure 100 rises, the shadow mask 102 deforms in a direction that moves it away from the glass 700 of the color CRT. The amount of deformation is greatest near the center of the shadow mask 102 and, by experiments performed by the inventors, this was found to be approximately 40 $\mu$m near the center. That is, there is a reduction to 40% of the approximately 100 $\mu$m deformation exhibited with the shadow mask 802 of the past.

Figure 4:
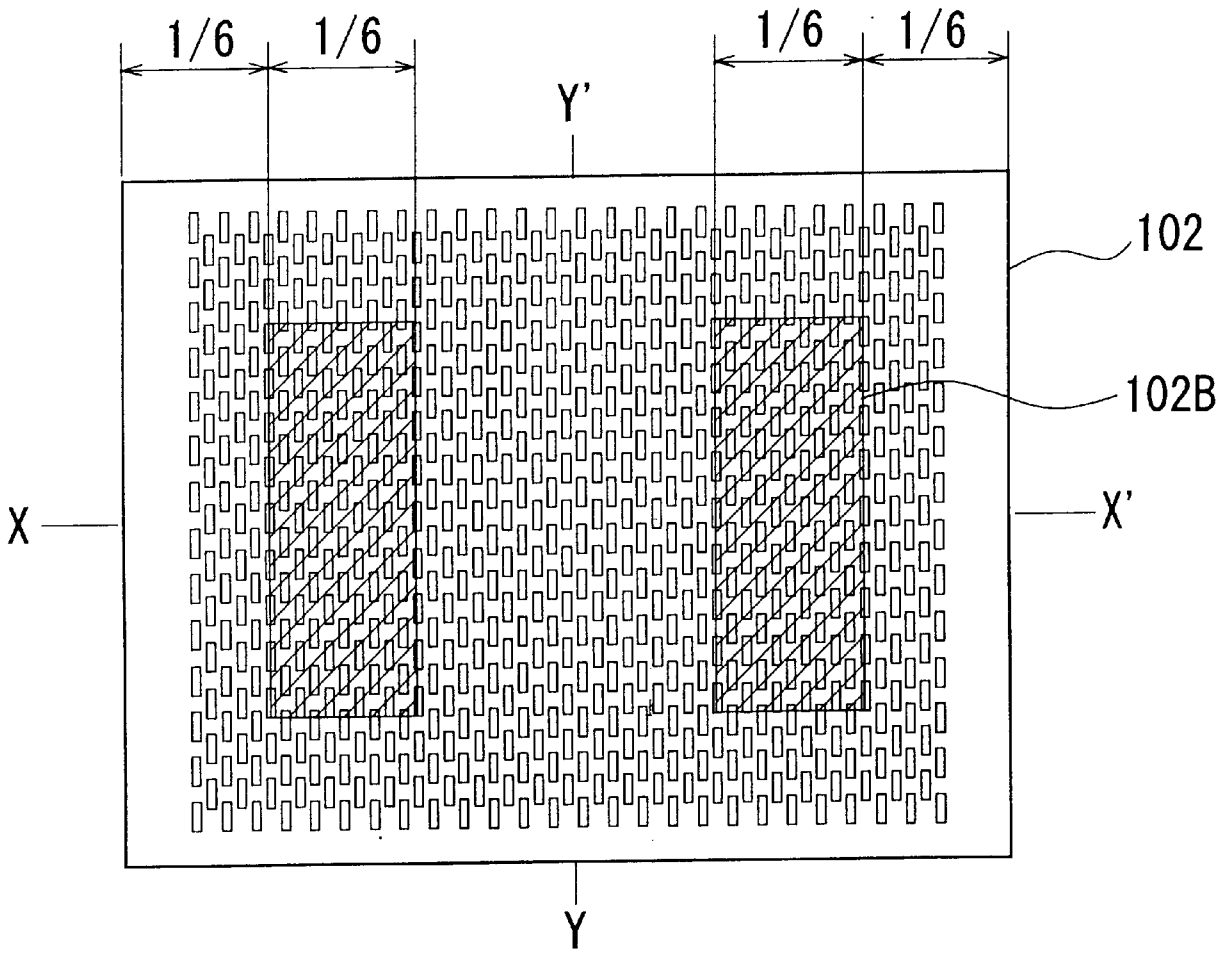
FIG. 4 is a plan view of a shadow mask of a shadow mask structure according to the first embodiment of the present invention.

For the reason described with regard to the prior art, in the shadow mask 102 of the first embodiment of the present invention, the greatest landing error occurs a region that is substantially ½ to ⅔ from the ends of the shadow mask 102, this being shown as the region 102B, indicated with hatching in FIG. 4 (plan view of the shadow mask 104). However, experiments by the inventors indicates that in shadow mask structure 100 of the first embodiment, the deformation of he shadow mask 102 is only 40 $\mu$m at the center part, the landing error in the region 102B being a maximum of 10 $\mu$m. This is ½ of the landing error of 20 $\mu$m that is exhibited by the shadow mask structure 800 of the past. With a landing error of approximately 10 $\mu$m, there is almost no perceivable decrease in color purity. Thus, the decrease in color purity caused by landing error that was a problem with a color CRT in the past does not occur with a color CRT using the shadow mask structure 100 according to the first embodiment of the present invention.

Additionally, an experiment by the inventors showed that, with a shadow mask 102 having a radius of curvature R1 of substantially 4500 to 6000 mm and a radius of curvature R2 of substantially 1000 to 2000 mm, there is substantially no decrease in color purity.

A shadow mask structure 500 according to a second embodiment of the present invention is described below.

Figure 5:
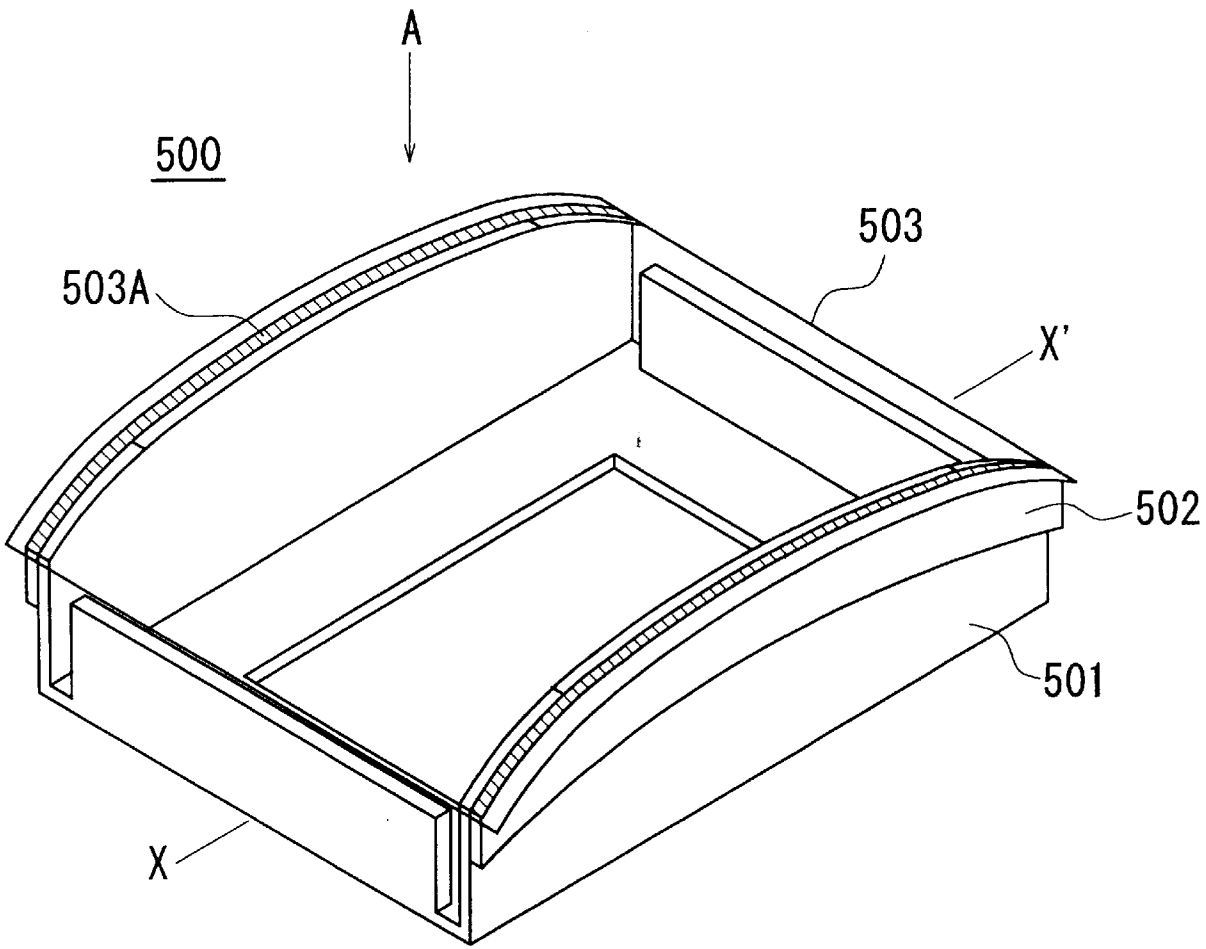
FIG. 5 is a perspective view of a shadow mask structure according to a second embodiment of the present invention.

FIG. 5 is a perspective view showing the shadow mask structure 500 according to the second embodiment. In this drawing, the reference numeral 501 is a mask frame, 502 is a mask supporting element, 503 is a shadow mask (only the periphery of which is shown, to make the inside of the shadow mask more visible), and 503A is the shadow mask welding point. The electron beam passage holes (not shown in the drawing) of the shadow mask 503 are rectangular, with a vertical dimension of approximately 260 $\mu$m, and a horizontal dimension of approximately 60 $\mu$m, the vertical direction thereof being parallel to the short sides of the shadow mask 503.

The shadow mask 503 is tensioned from two sides (long sides) of the mask frame 501, via the shadow mask welding points 503A.

The mask frame 501 is 2.2-mm-thick 13 chromium stainless steel, the mask supporting elements 502 are 3 mm-thick Invar, an the shadow mask 503 is 0.1 mm-thick Invar. The approximate dimensions of the shadow mask structure 500 are 360 mm on the long sides, and 270 mm on the short sides, with a height of 43 mm, for a 19-inch color CRT.

Figure 6:
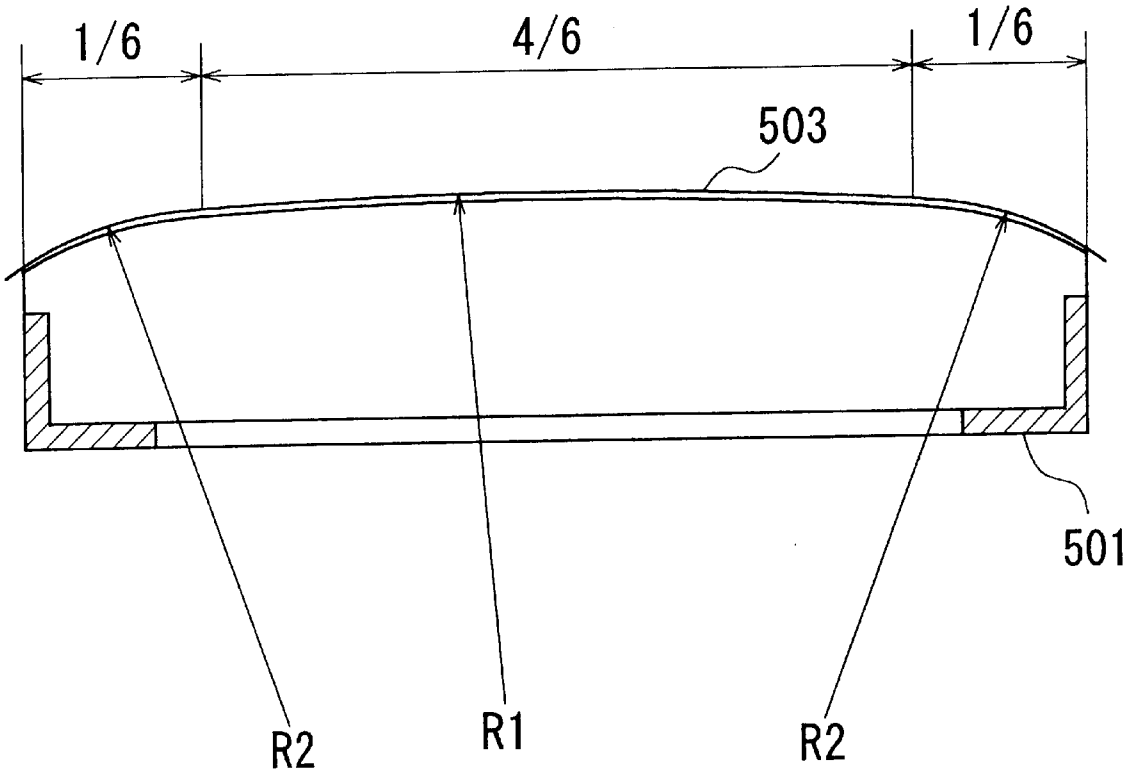
FIG. 6 is a cross-sectional view of a shadow mask structure according to the second embodiment of the present invention.
Figure 7:
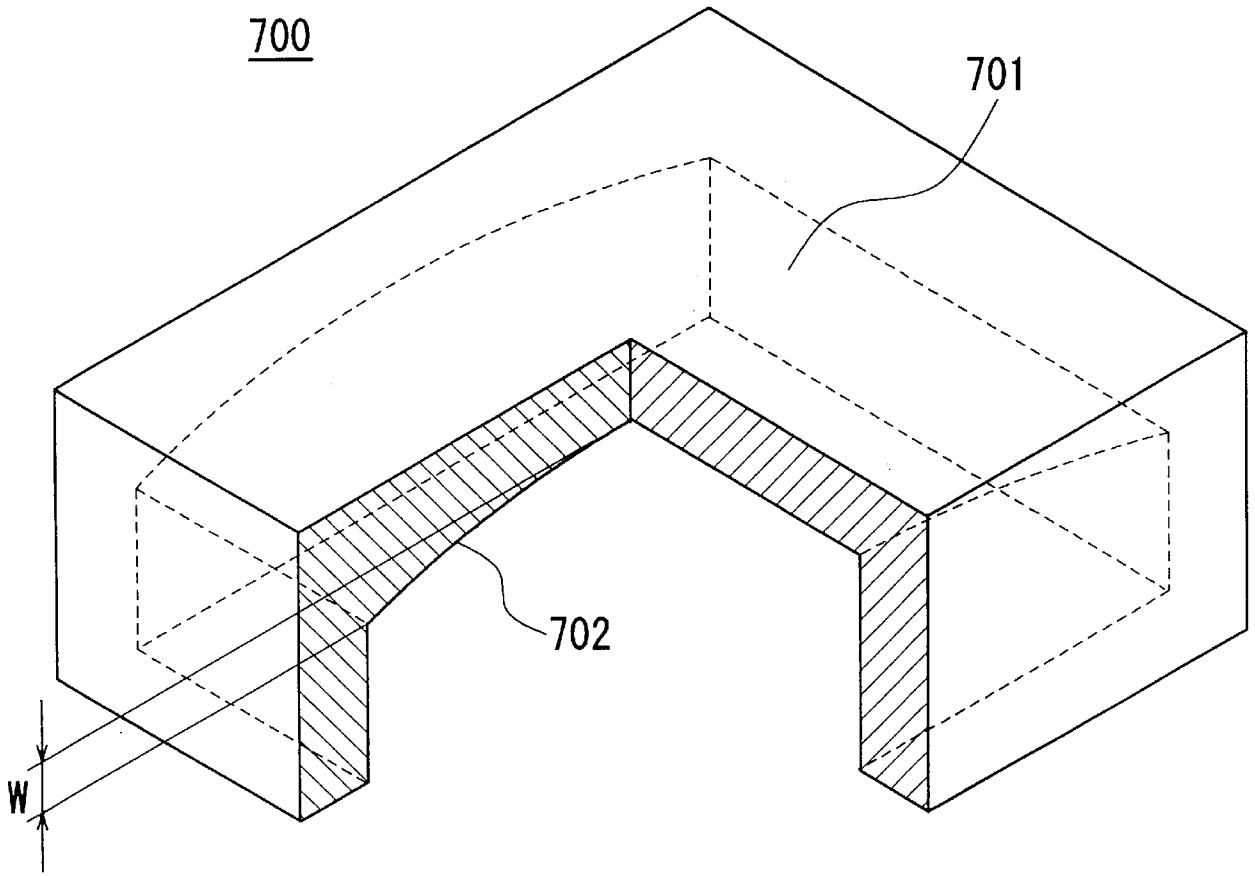
FIG. 7 is a partial perspective cross-sectional view of glass panel for a flat display tube.
Figure 8:
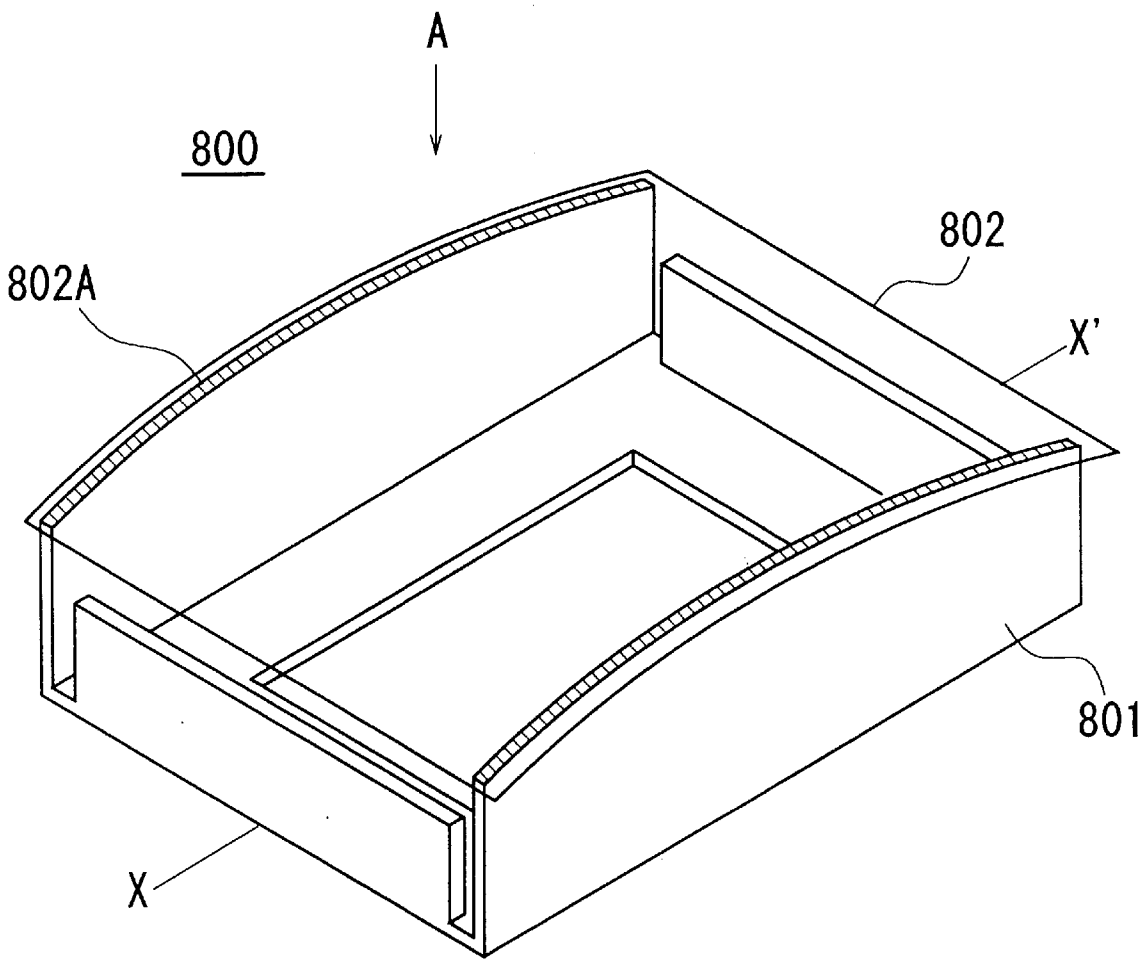
FIG. 8 is a perspective view of a shadow mask structure of the past.
Figure 9:
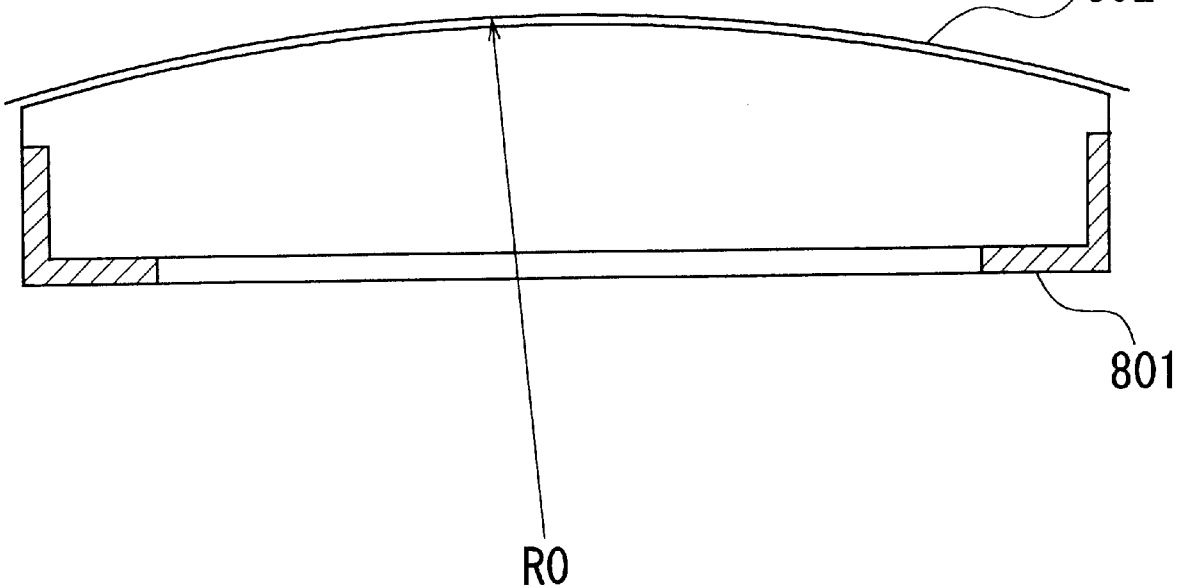
FIG. 9 is a cross-sectional view of a shadow mask structure of the past.
Figure 10:
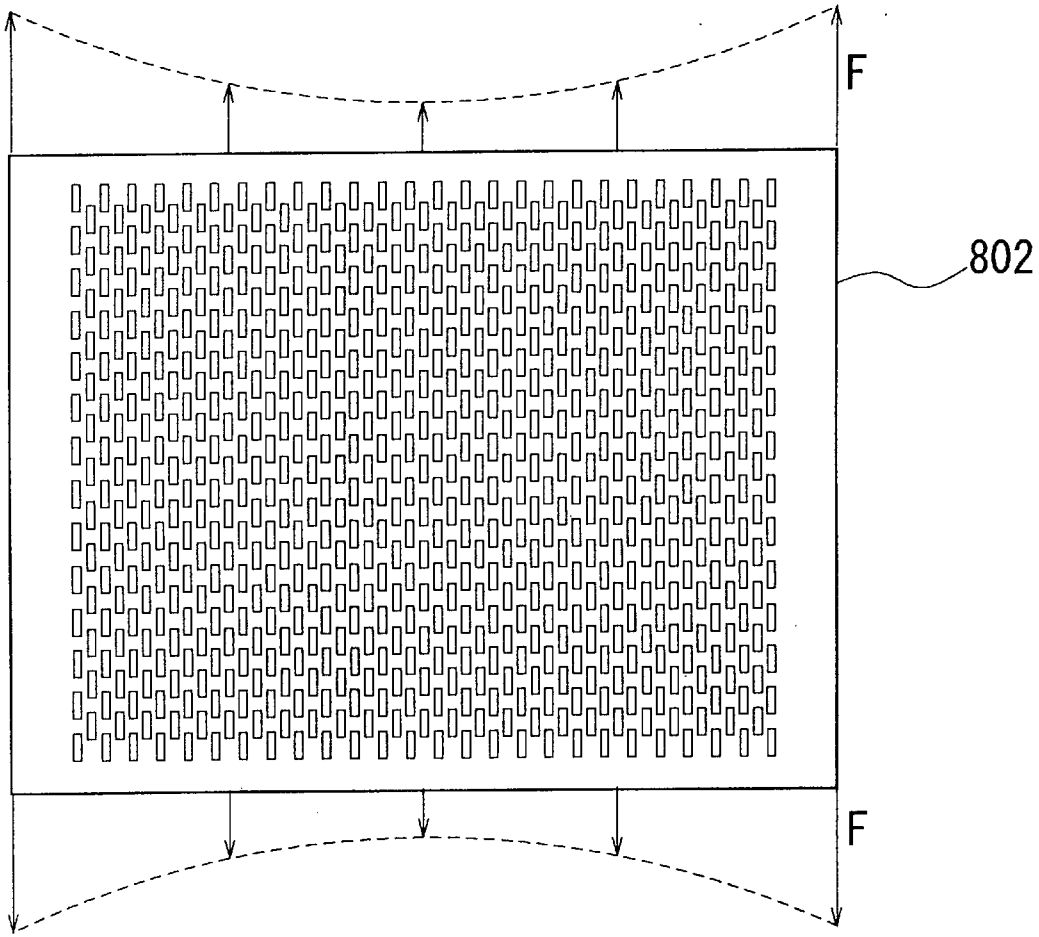
FIG. 10 is a plan view of a shadow mask of the past.
Figure 11:
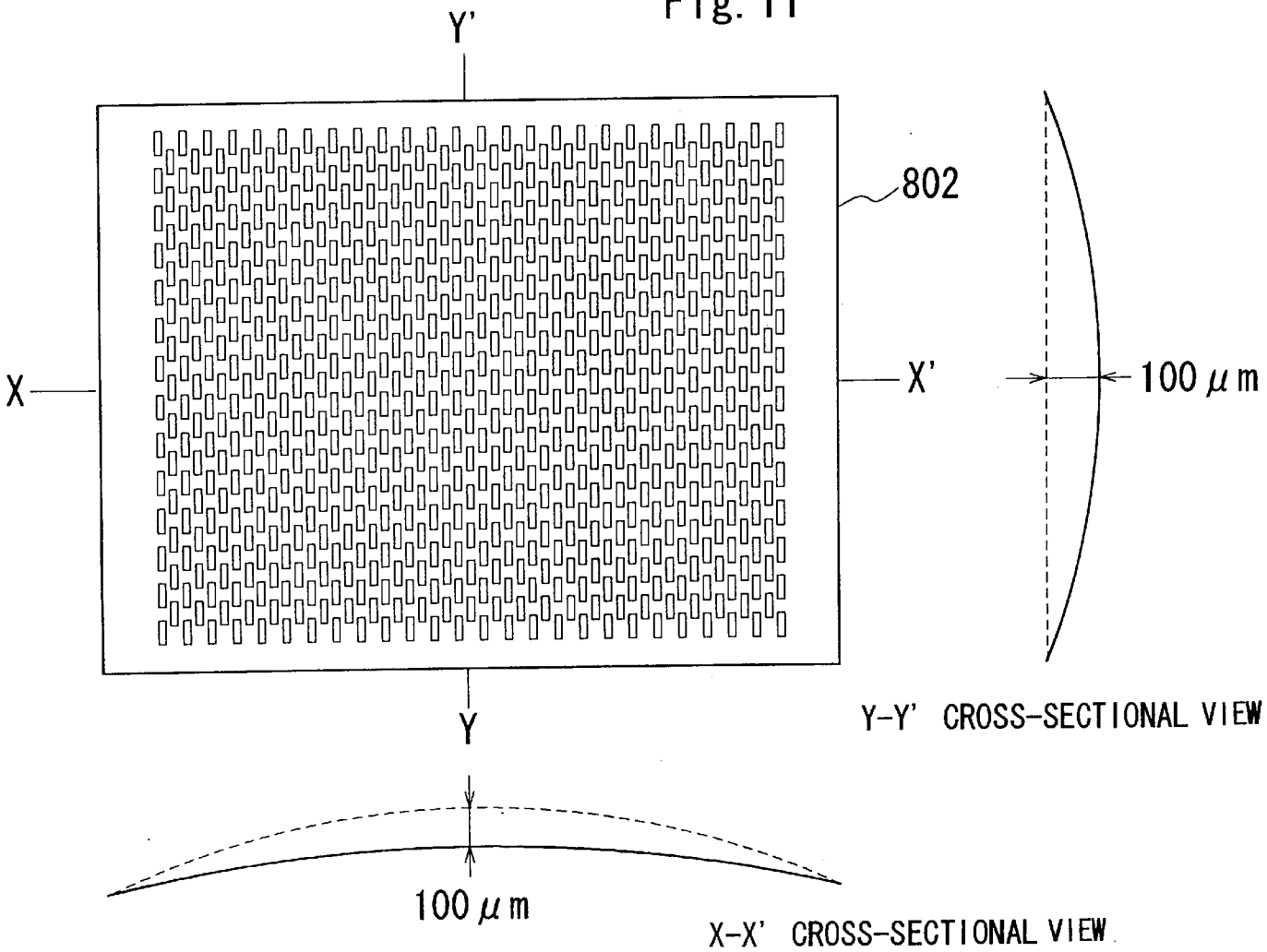
FIG. 11 is a plan and cross-sectional view of a shadow mask of the past.
Figure 12:
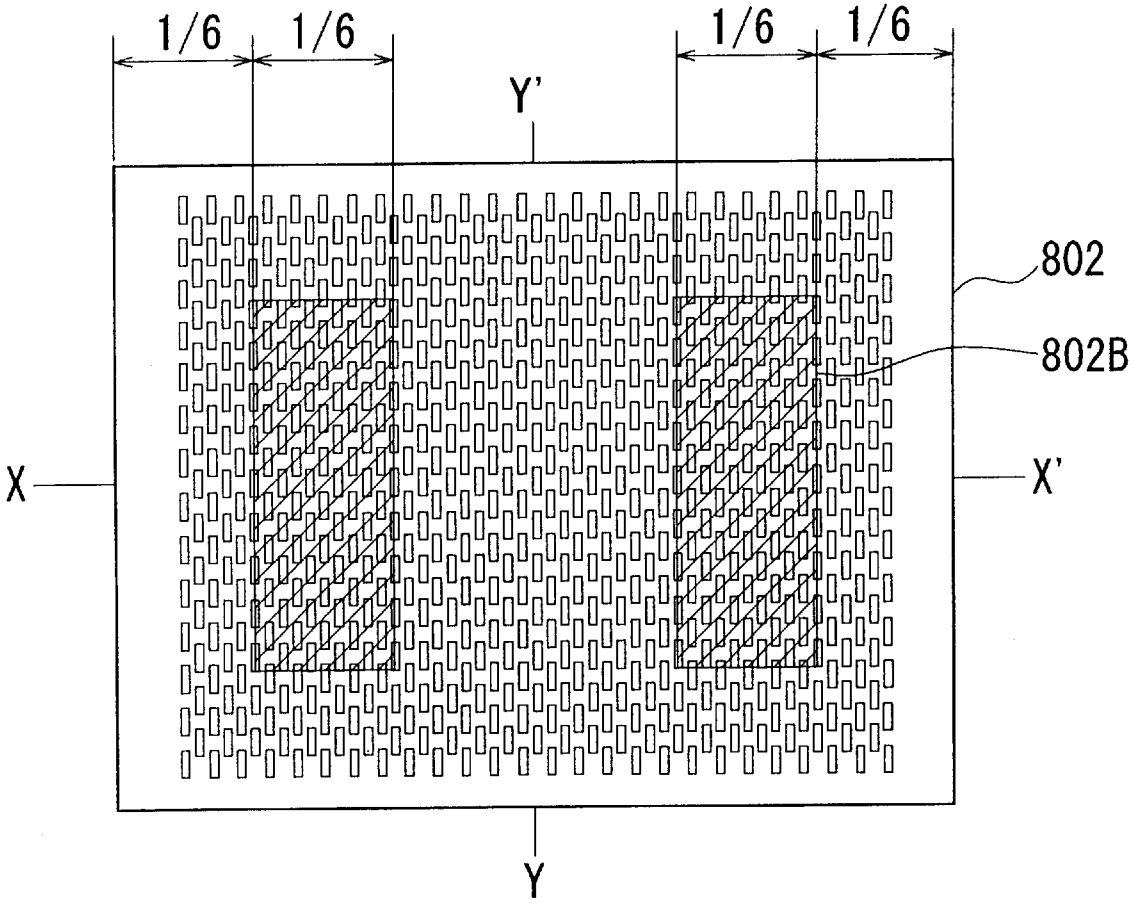
FIG. 12 is a plan view of a shadow mask of the past.

FIG. 6 is an X–X' cross-sectional view of a shadow mask structure 500 according to the second embodiment of the present invention. As shown in FIG. 6, the cross-sectional shape of the shadow mask 503 (which is the same as the shape of the upper surface of the mask supporting element), is such that the center ⅔ is an arc with a radius of R1, and the left and right ⅙ thereof are arcs with a radius of R2. The radii of curvature R1 and R2 are such that the condition R2<R0<R1 is satisfied, where R0 is the radius of curvature of a shadow mask structure 800 of the past. Specifically, with respect to an R of 4050 mm, R1 is 5090 mm, and R2 is 1530 mm. With the above-noted shapes the mask frame 101 and shadow mask 102 present no particular problems in manufacturing a shadow mask structure 500 according to the second embodiment of the present invention.

In a shadow mask structure 500 according to the second embodiment, by a mechanism similar to the case of a shadow mask structure 100 according to the first embodiment, there is deformation of the shadow mask 503. However, the deformation of the shadow mask 503 is smaller than that of the shadow mask structure 100, as is the landing error. An experiment by the inventors indicated that the degree of landing error with the shadow mask structure 500 of the second embodiment is approximately the same as with the shadow mask structure 100 of the first embodiment.

The shadow mask structure 500 according to the second embodiment offers an advantage compared to the shadow mask structure 100 of the first embodiment. With the shadow mask structure 100 of the first embodiment, the entirety of the long sides of the mask frame 101 is Invar, whereas in the shadow mask structure 500 of the second embodiment, only the mask supporting element is made of Invar. Thus, the shadow mask structure 500 of the second embodiment consumes less Invar. Because Invar is considerably more expensive than 13 chromium stainless steel, the reduction in the amount of Invar used, enables a reduction in the cost of the shadow mask structure 500 of the second embodiment.

In either of the shadow mask structures 100 or 500 of the first and second embodiment of the present invention, tension is applied to the shadow mask 102 and 503, respectively, at the long sides of the mask frame 101 and 501, respectively. Therefore, the more springiness the long sides of the mask frames 101 or 501 have, the more effective will be the application of tension to the shadow masks 102 and 503, respectively. Because Invar has poor springiness and 13 chromium stainless steel has good springiness, the shadow mask structure 500 of the second embodiment, which uses 13 chromium stainless steel for the long sides of the mask frame 501 has an advantage over the shadow mask structure 100 of the first embodiment, in that it is better able to apply uniform tension to the shadow mask 501.

As described in detail above, in a shadow mask structure according to the present invention, because the radius of curvature of the shadow mask at the center part of the screen is different from the radius of curvature of the shadow mask at the periphery of the screen, even if the temperature of the shadow mask structure rises during use in color CRT, deformation of the shadow mask does not occur to a degree which causes a landing error problem.

It is further possible by applying the shadow mask structure of the according to the present invention to a color CRT to achieve a color CRT with superior color purity, a natural flat appearance, and a sufficient withstand pressure.

What is claimed is:

1. A shadow mask structure comprising:

a mask frame with a substantially rectangular outer frame; and a shadow mask that is substantially rectangular and that is provided on said mask frame, wherein a pair of long sides of the mask frame onto which ends portion of the shadow mask is provided, is formed by a combination of a plurality of arcs, the radii of curvature of said plurality of arcs becoming successively longer with movement from a center of said long side of said mask frame to end of said side of said mask frame, the cross-section of said shadow mask that is parallel to said long side of said frame having substantially the same shape as that of said long side frame so as to give tension to said mask.

2. A shadow mask structure according to claim 1, wherein a portion of said long side of said mask frame has a shape of combination of arcs that has two radii of curvature, wherein approximately ⅔ at a center part of said long side of said mask frame has the larger arc of said two radii of curvature, and the left and right ⅙ of said end portion have the smaller arc of said two radii of curvature.

3. A shadow mask structure according to claim 2, wherein the larger radius of curvature of said arc is substantially 4500 mm to 6000 mm, and the smaller radius of curvature of said arc is substantially 1000 mm to 2000 mm.

4. A shadow mask structure according to claim 1, wherein the material of said long sides of said mask frame is invar, and wherein the material of another part of said mask frame is 13 chromium stainless, said shadow mask material being invar.

5. A shadow mask comprising:

a mask frame having a substantially rectangular outer frame; and a shadow mask that is substantially rectangular, said shadow mask structure comprising a pair of mask supporting elements on a pair of longer sides of said mask frame, wherein an end side portion of said shadow mask is contacted to each one of said pair of long side of said mask supporting elements so as to give tension to said shadow mask to form a shadow mask tensioning part, and wherein said shadow mask tensioning part of said mask supporting elements is formed by a plurality of arcs, the radii of curvature of said plurality of arcs becoming successively smaller with movement from the center of said mask supporting elements toward the end portion thereof, and a cross-section of said shadow mask that is parallel to said mask supporting elements having a shape that is substantially the same as said shadow mask tensioning part of said mask supporting elements.

6. A shadow mask structure according to claim 5, wherein said shadow mask tensioning part of said mask supporting elements is a combination of arcs that has two radii of curvature, where substantially ⅔ of a center part of said mask supporting elements is an arc having the larger of said radii of curvature and substantially ⅙ of said shadow mask supporting elements to the right and left sides have the smaller of said two radii of curvature.

7. A shadow mask structure according to claim 6, wherein the larger radius of curvature of said arc is substantially 4500 mm to 6000 mm, and wherein the smaller radius of curvature of said arc is approximately 1000 mm to 2000 mm.

8. A shadow mask structure according to claim 5, wherein the material of said mask frame is 13 chromium stainless steel, and wherein the material of the mask supporting elements and the shadow mask is invar.

9. A shadow mask structure according to claim 1, wherein the shape of a hole in said shadow mask through which an electron beam passes is substantially rectangular.

10. A color CRT comprising a shadow mask structure according to claim 1.

* * * * *